US009488346B2

(12) United States Patent
Yu et al.

(10) Patent No.: US 9,488,346 B2
(45) Date of Patent: Nov. 8, 2016

(54) LUMINAIRE MOUNTING SYSTEM

(71) Applicants: Scott S Yu, Mil Valley, CA (US); Thomas Warton, Sonoma, CA (US)

(72) Inventors: Scott S Yu, Mil Valley, CA (US); Thomas Warton, Sonoma, CA (US)

( * ) Notice: Subject to any disclaimer, the term of this patent is extended or adjusted under 35 U.S.C. 154(b) by 137 days.

(21) Appl. No.: 14/213,252

(22) Filed: Mar. 14, 2014

(65) Prior Publication Data

US 2014/0268718 A1 Sep. 18, 2014

Related U.S. Application Data

(60) Provisional application No. 61/801,406, filed on Mar. 15, 2013.

(51) Int. Cl.

| | |
|---|---|
| ***F21V 21/00*** | (2006.01) |
| ***F21V 19/00*** | (2006.01) |
| ***F21K 99/00*** | (2016.01) |
| ***F21S 2/00*** | (2016.01) |
| ***F21V 21/005*** | (2006.01) |
| ***F21V 23/06*** | (2006.01) |

(52) U.S. Cl.

CPC ..... *F21V 19/008* (2013.01); *F21K 9/175* (2013.01); *F21S 2/005* (2013.01); *F21V 21/005* (2013.01); *F21V 23/06* (2013.01)

(58) Field of Classification Search

CPC ..... F21V 19/008; F21V 19/0085; F21V 19/009; F21V 23/06; F21V 21/005; F21S 8/066; F21K 9/175

See application file for complete search history.

(56) References Cited

U.S. PATENT DOCUMENTS

| | | | | |
|---|---|---|---|---|
| 3,384,858 | A * | 5/1968 | Johnson | 439/237 |
| 4,521,839 | A * | 6/1985 | Cook et al. | 362/238 |
| 5,357,412 | A * | 10/1994 | Entrop et al. | 362/219 |
| 7,207,696 | B1 * | 4/2007 | Lin | F21V 14/02 362/232 |
| 2010/0103673 | A1 * | 4/2010 | Ivey et al. | 362/249.02 |

* cited by examiner

*Primary Examiner* — Peggy Neils
*Assistant Examiner* — Alexander Garlen
(74) *Attorney, Agent, or Firm* — Peter Tormey; Anteo & Tormey PC

(57) ABSTRACT

A device including a hub portion, said hub portion including an opening with spring-loaded electrical contacts slidably disposed in said opening, a light rail an extended portion and a power contact disposed on the extended portion, wherein the light rail is operable to slide into the opening and couple the power contact to the spring-loaded contact. The extended portion may include an o-ring for fixing the light rail and the hub may have a cable for mounting and coupling power to the spring-loaded electrical contact. Some embodiments may have a second opening in said hub portion, and a second end for the light rail. Power may be coupled through the light rail to hubs on each end.

7 Claims, 4 Drawing Sheets

LUMINAIRE MOUNTING SYSTEM

PRIORITY

This application claims the benefit of provisional patent application 61/801,406 filed Mar. 15, 2013 entitled "Luminaire Mounting System" by the same inventors which is incorporated by reference as if fully set forth herein.

SUMMARY

Disclosed herein are systems and methods for luminaires and their mountings and installations including a device including a hub portion, said hub portion including an opening with spring-loaded electrical contacts slidably disposed in said opening, a light rail with an extended portion and a power contact disposed on the extended portion, wherein the light rail is operable to slide into the opening and couple the power from the to the spring-loaded contact. The extended portion may include an o-ring for fixing the light rail and the hub may include a cable for mounting and coupling power to the spring-loaded electrical contact. Some embodiments may have a second opening in said hub portion, and a second end for the light rail. Power may be coupled through the light rail to hubs on each end.

The construction and method of operation of the invention, however, together with additional objectives and advantages thereof will be best understood from the following description of specific embodiments when read in connection with the accompanying drawings.

DESCRIPTION

Generality of Invention

Figure 1:
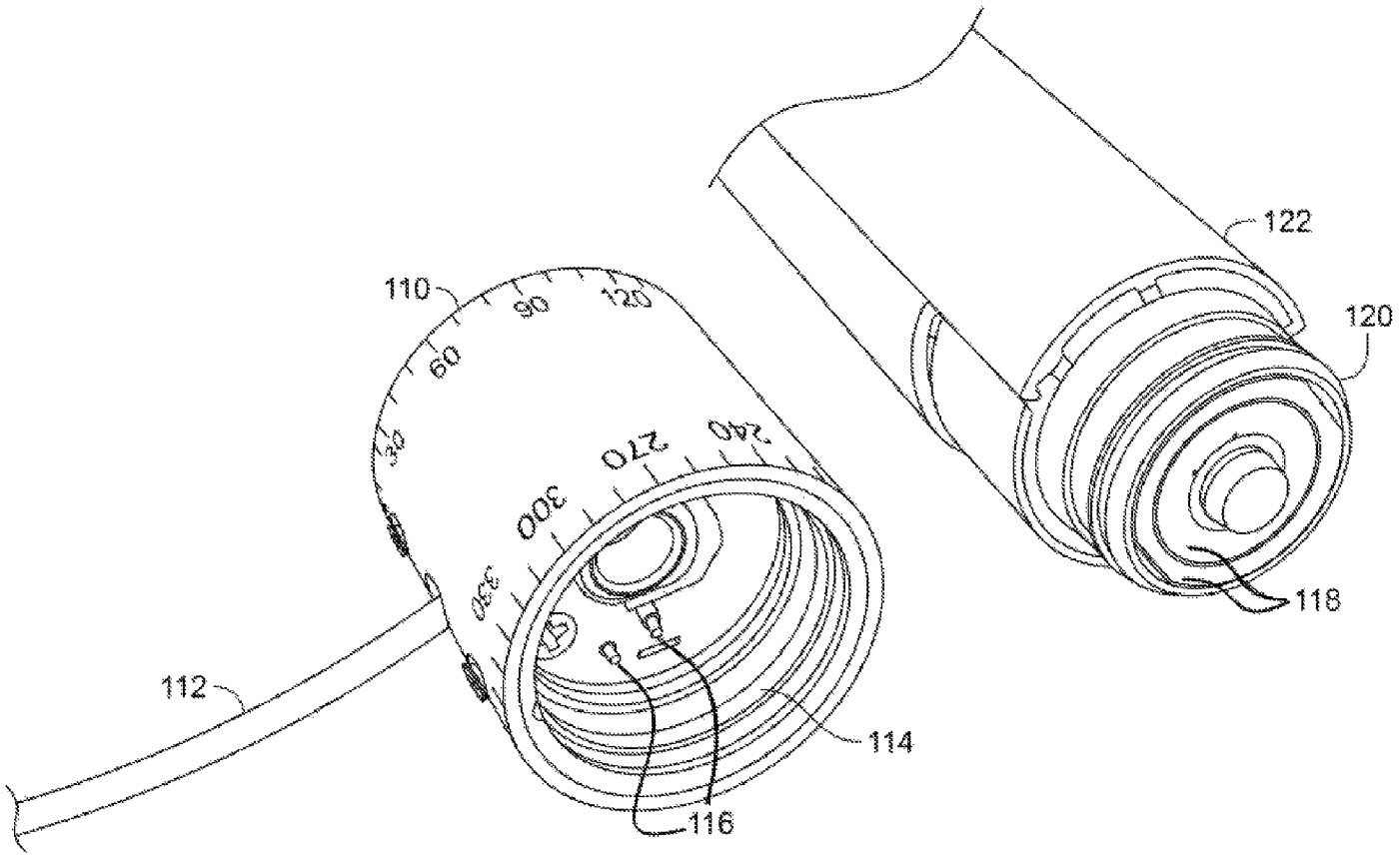
FIG. 1 shows a picture of one embodiments of a luminaire Mounting System according to certain aspects of the current disclosure.

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to contemplated causes and effects for some implementations do not preclude other causes or effects that might occur in other implementations.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application.

DETAILED DESCRIPTION

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

System Elements

FIG. 1 shows a picture of one embodiments of a luminaire Mounting System according to certain aspects of the current disclosure. In FIG. 1 a hub 110 is shown having a cable 112 for suspending the hub 110 into position. The cable 112 may include electrical conductors for supplying power to the hub 110. The hub includes at least one opening and disposed in the connection opening is a grooved surface 114. Inside the opening on the hub 110 are spring-loaded connectors 116 which in certain embodiments may be electrically coupled to electrical conductors in the cable 112. In some embodiments the cable 112 may be comprised completely of power cables, whereas in others luminescence control signals may be included Certain embodiments may include a light rail 122, which is a structure for holding a lamp, LED or other light source. A light rail 122 may include various forms of reflectors for directing light in certain directions. The light rail 122 has an elongated portion 120 extending partially outside the light rail 122. The elongated portion 120 is formed to fit into the connection opening (or cavity) on the hub 110. The elongated portion may include an o-ring formed to secure the light rail 122 into the hub 110. The o-ring may be made of plastic, a polymer or a metal and operates to hold the light rail 122 snugly to the hub 110. On the end of the elongated portion 120 are circular metallic rings 118 which may be electrically connected to a light source in the light rail 122.

In operation the light rail 122 is coupled to a hub 110 by inserting the elongated portion 120 into the opening on the hub 110. The light rail 122 is held in place by the snug fit to the hub 110. The hub 110 may be suspended by the cable 112 and the electrical wires in the cable 112 connected to a power source. Once in place the spring-loaded connectors 116 make contact with the metal rings 118. This disclosure allows for full rotation of the light rail 122 with respect to the hub 110 because power to the light rail is accomplished through the spring-loaded pins 116 coupling to the metallic rings 118. Sufficient insulation between the pins and hub material may be achieved using spacing and non-conducting material. Moreover, for low voltage lighting systems electrical insulation may be easier accomplished because of the reduced electrical potential.

Other embodiments may be effectuated by placing one or more spring-loaded pins on the light rail and having the metallic ring disposed in the opening on the hub. Moreover, certain embodiments may allow for connecting light sources in parallel or in series within the light rail. In other embodiments the spring-loaded pins and/or electrical contacts are on each end of the light rail and coupled together. In certain embodiments this allows for light rails to be coupled together and share a power source.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
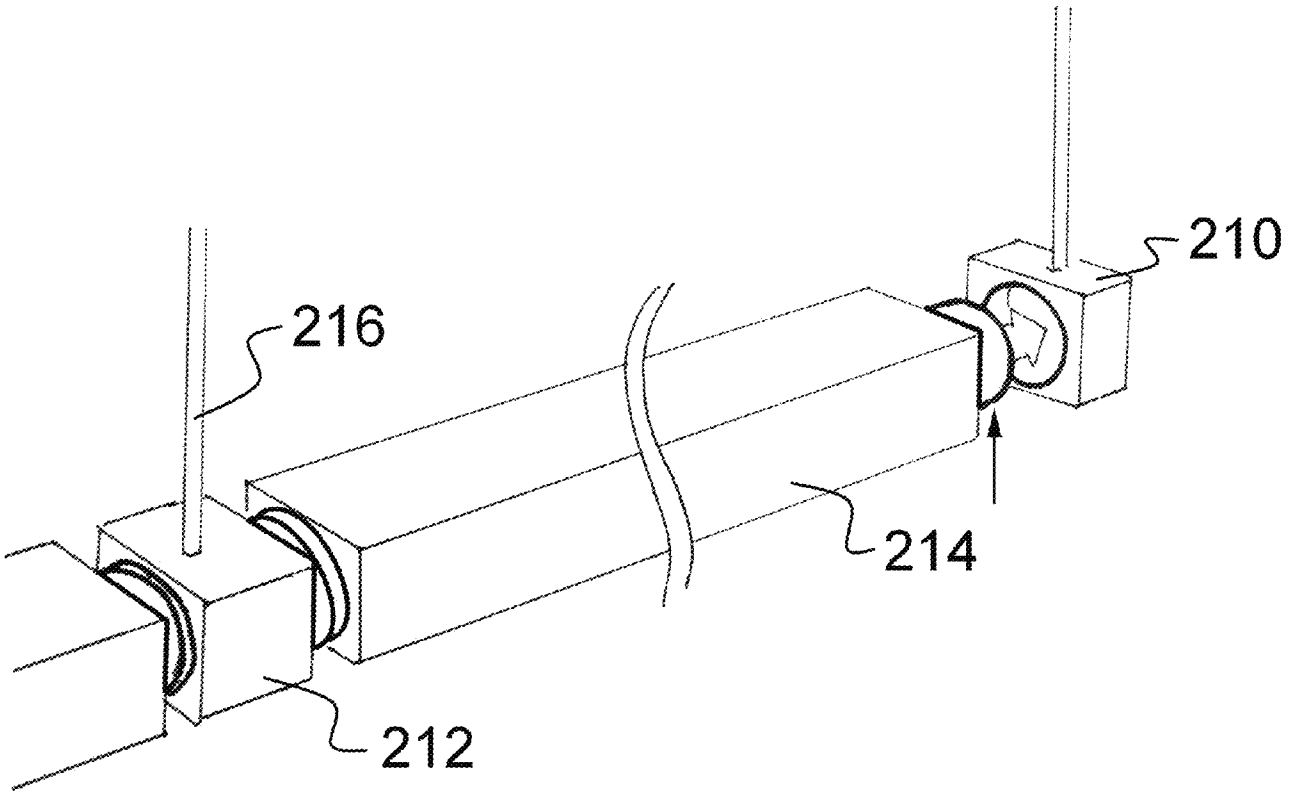
FIG. 2 illustrates how multiple light rails may be coupled together using single-ended or double-sided hubs.

FIG. 2 illustrates how multiple light rails may be coupled together using single-ended or double-sided hubs. In FIG. 2, a hub may be formed as a single hub 210 (i.e. having a single connection opening) or as a double hub 212 having two connection openings. One or more light rails 214 may be suspended from the hubs 210 and 212. Moreover, different light rails may be suspended from different hubs to create a serial luminaire which may include different light rails in different positions. For example and without limitation the light rail may project light in one pattern at the ends of the luminaire and a different pattern in the middle of the luminaire. In addition, hubs may be constructed having more than a single dimension. For example and without limitation hubs may be constructed using the techniques described here to hold three or four light rails or vertically to hold light "stacked" luminaires.

The double hub 212 may be constructed to allow for the spring-loaded pins in each connection opening to be electrically coupled. This may allow for power coming through the cable 216 to be provided to multiple light rails 214. Other embodiments of the double hub 212 may provide for electrical contacts to be coupled between to connection openings without providing power through the cable 216. In these embodiments power may be coupled from a first light rail through the double hub 212 to a second light rail and alleviate the need to provide external power to the double hub 212.

Figure 3:
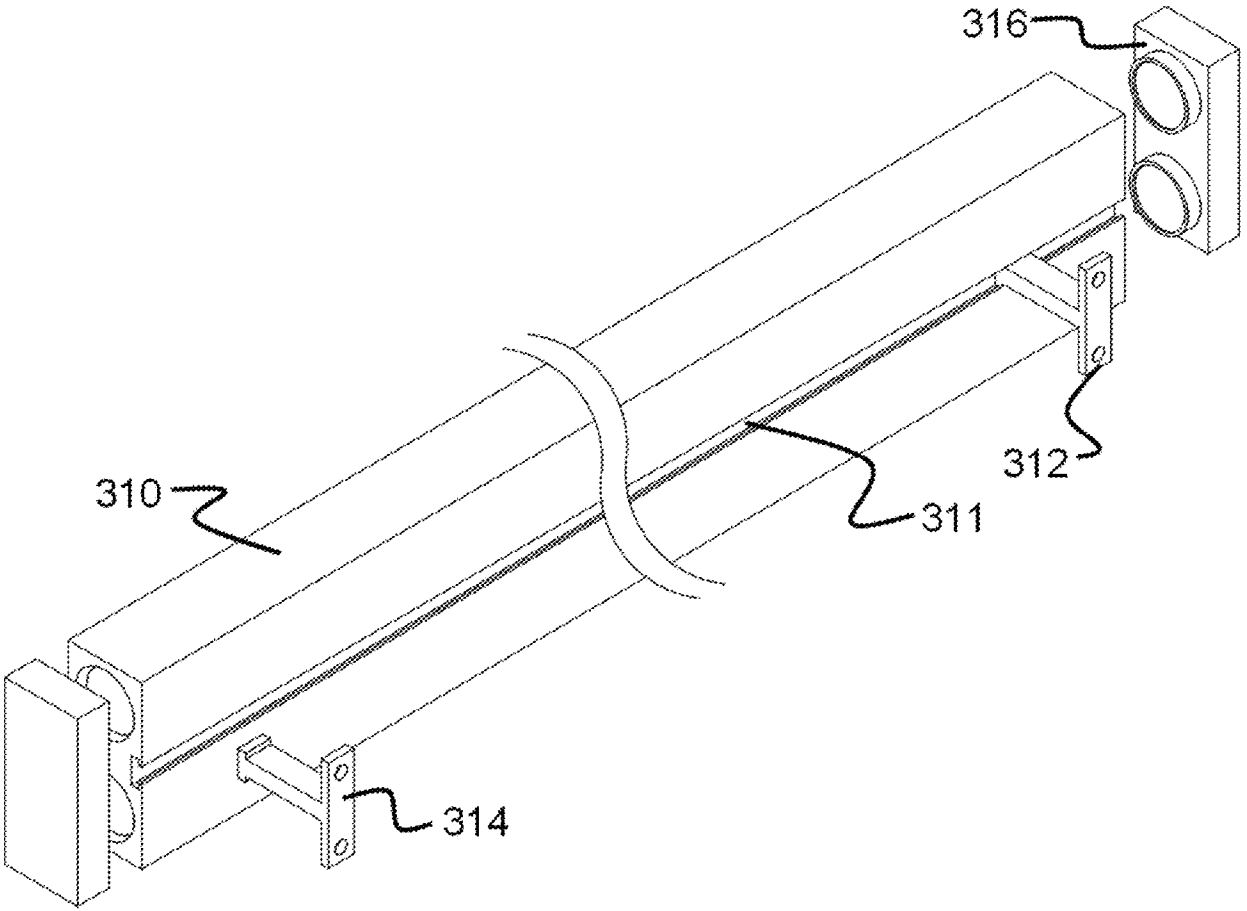
FIG. 3 shows an alternative embodiment of a luminaire mounting system.

FIG. 3 shows an alternative embodiment of a luminaire mounting system. In FIG. 3 a light rail 310 is formed with a channel 311 along one side. One having skill in the art will appreciate that light rail may use different many types of light sources such as lamps, LEDs and others, and provide for directing the light through the operation of differing reflectors. Mounts 312 and 314 are operable to slide into the channel 311. The mounts 312 and 314 are formed to lock into the channel which might be effectuated using removable end caps 316 to allow the mounts to be initially positioned. The mounts 312 and 314 are slidable and are capable of moving along the channel 311. As shown the mounts include two raised surfaces that project into the channel 311 for increasing stability, however, nothing in this disclosure should be read to require those surfaces in every embodiment.

FIG. 3 show an easy to install luminaire because the mounts 312 and 314 may be placed along a surface, the end caps removed and the luminaire then slid into place. Once in place the end caps 311 may be reinstalled. While the light rail is shown as an elongated rectangle, the light rail may be other shapes that will accommodate the channel 311 and mounts 312. For example and without limitation a light rail may have a flat surface, similar to that shown, and include a semicircular surface opposite to the flat side.

Figure 4:
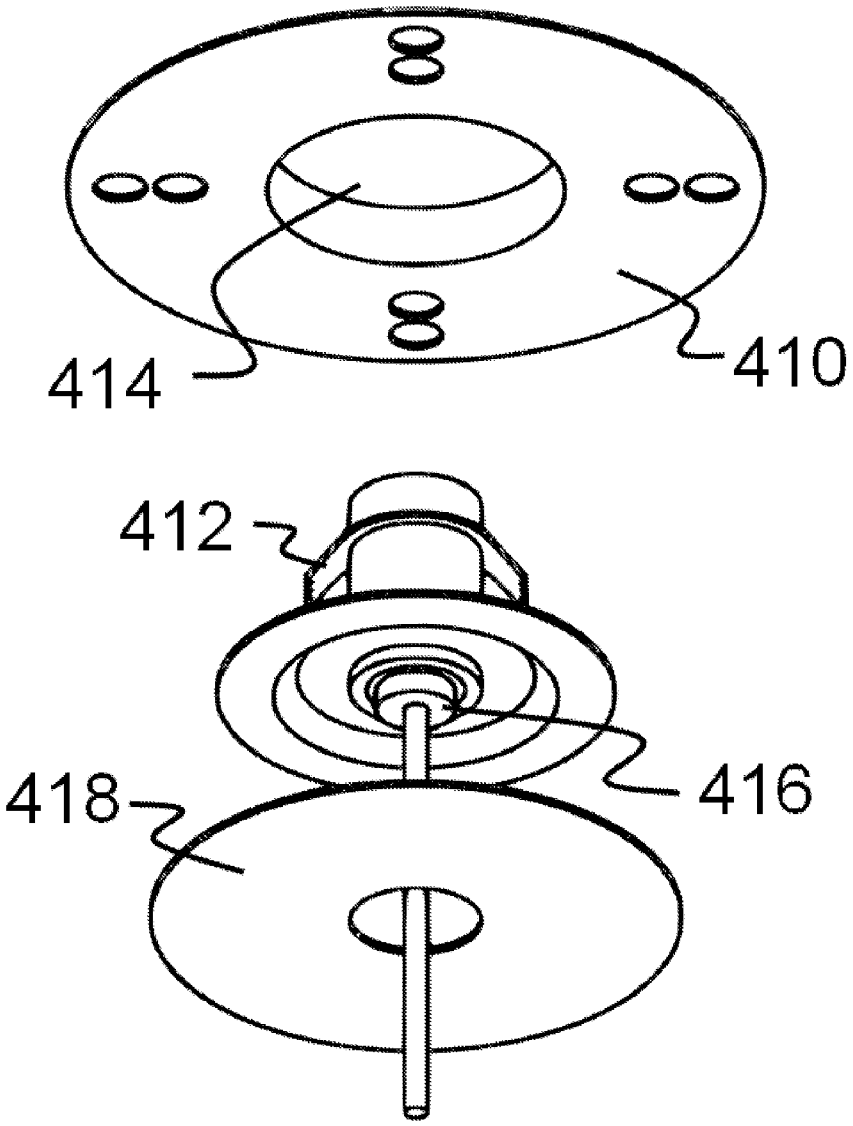
FIG. 4 shows a suspension canopy assembly according to certain aspects of the current disclosure.

FIG. 4 shows a suspension canopy assembly according to certain aspects of the current disclosure. An adaptor plate 410 may be mounted to a J-box or other structure. The adapter plate 410 may be formed with an aperture 414 for receiving an expansion wedge 412 which grips the interior surface of an aperture 414 in the adapter plate 410. A power cord may be suspended from the device by using a conventional cable gripper 416 which holds the cable to a lower plate 418. In some embodiments the cable gripper may include a quick release mechanism.

In operation the adaptor plate 410 may be connected to a J-box or other fixture mount in a ceiling or wall. The power cable may pass through the aperture 414 for connection between a light source and a power source.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed:

1. A device including:

a hub portion, said hub portion including a first cavity wherein the first cavity has an inside surface, wherein the inside surface has a primary chamber;

a first and a second spring-loaded electrical contact disposed in the primary chamber, wherein the first and second spring-loaded electrical contacts extend into the first cavity, a light rail, said light rail including an extended portion, wherein the light rail has a longitudinal axis;

a first electrical contact ring disposed on the extended portion substantially coaxial to the longitudinal axis, and a second electrical contact ring disposed on the extended portion substantially coaxial to the longitudinal axis;

wherein the light rail is operable to slide into the first cavity, wherein the first electrical contact ring is operable to substantially bear against the first spring-loaded electrical contact, and the second electrical contact ring is operable to substantially bear against the second spring-loaded electrical contact, thereby maintaining a substantially continuous electrical connection between the first electrical contact ring and the first spring-loaded electrical contact the during rotation of the light rail along the longitudinal axis.

2. The device of claim 1 wherein the extended portion includes an O-ring.

3. The device of claim 1 further including:

a cable portion, said cable portion coupled to the spring-loaded electrical contact and extending exterior of said hub portion.

4. The device of claim 1 further including:

a second cavity in said hub portion, wherein the second cavity includes a secondary chamber;

a second spring-loaded electrical contact disposed in the secondary chamber, wherein the second spring-loaded electrical contact extends into the second cavity, wherein the second spring-loaded electrical contact is operable to at least partially retract into the at least one secondary chamber.

5. The device of claim 1 further including:

a second extended portion disposed on the light rail opposite the extended portion, and an electrical contact ring disposed on the second extended portion substantially coaxial to the longitudinal axis.

6. The device of claim 5 wherein the light rail is operable to slide into the second cavity, wherein the second electrical contact ring is operable to substantially continuously bear against the second spring-loaded electrical contact, thereby maintaining a substantially continuous electrical connection between the second electrical contact ring and the second spring-loaded electrical contact the during rotation of the light rail along the longitudinal axis.

7. A device including:

a hub, said hub having a cavity;

a first spring-loaded electrical contact disposed to extend into the cavity;

a second spring-loaded electrical contact disposed to extend into the cavity;

a light rail, said light rail having an elongated portion operable to slide into the cavity, said elongated portion including an inner contact ring and an outer contact ring, wherein, when the elongated portion is disposed in the cavity, the first spring-loaded electrical contact is electrically coupled to the first contact ring and the second electrical contact is electrically coupled to the second electrical contact ring, and the contact is substantially made when the light rail is rotated.

* * * * *